US010415890B2

(12) United States Patent
Ahamed et al.

(10) Patent No.: US 10,415,890 B2
(45) Date of Patent: Sep. 17, 2019

(54) HEAT PIPE

(71) Applicant: FUJIKURA LTD., Tokyo (JP)

(72) Inventors: Mohammad Shahed Ahamed, Tokyo (JP); Yuji Saito, Tokyo (JP)

(73) Assignee: FUJIKURA, LTD., Tokyo (JP)

( * ) Notice: Subject to any disclaimer, the term of this patent is extended or adjusted under 35 U.S.C. 154(b) by 57 days.

(21) Appl. No.: 14/799,196

(22) Filed: Jul. 14, 2015

(65) Prior Publication Data

US 2016/0018165 A1 Jan. 21, 2016

(30) Foreign Application Priority Data

Jul. 15, 2014 (JP) ..... 2014-145301

(51) Int. Cl.
*F28D 15/04* (2006.01)
*F28D 15/02* (2006.01)

(52) U.S. Cl.
CPC ..... *F28D 15/04* (2013.01); *F28D 15/0233* (2013.01); *F28D 15/046* (2013.01)

(58) Field of Classification Search
CPC ..... F28D 15/04; F28D 15/046; F28D 15/02; F28D 15/233
USPC ..... 165/104.26
See application file for complete search history.

(56) References Cited

U.S. PATENT DOCUMENTS 6,619,384 B2 * 9/2003 Moon ..... F28D 15/046 165/104.26
9,689,625 B2 * 6/2017 Dai ..... F28D 15/046
2011/0303392 A1 * 12/2011 Horiuchi ..... F28D 15/046 165/104.26
2012/0118537 A1 * 5/2012 Kameoka ..... F28D 15/0233 165/104.26
2012/0175084 A1 * 7/2012 Horng ..... F28D 15/02 165/104.26
2012/0325440 A1 * 12/2012 Honmura ..... F28F 21/084 165/104.26
2013/0213612 A1 * 8/2013 Wu ..... F28D 15/046 165/104.26
2014/0166244 A1 * 6/2014 Dai ..... F28D 15/046 165/104.26
2014/0290914 A1 * 10/2014 Chiou ..... F28D 15/046 165/104.26
2015/0176918 A1 * 6/2015 Pai ..... F28D 15/0233 165/104.26

FOREIGN PATENT DOCUMENTS

JP 2012229879 A * 11/2012 ..... F28D 15/0233
JP 2013-002641 A 1/2013

OTHER PUBLICATIONS

JP 2013 002640 (English translation) (Year: 2013).*

* cited by examiner

*Primary Examiner* — Jonathan Bradford
(74) *Attorney, Agent, or Firm* — Sughrue Mion, PLLC

(57) ABSTRACT

A heat pipe having enhanced heat transport capacity that can be manufactured easily is provided. The heat pipe 1 comprises a sealed container 2 and a wick structure 10. The wick structure includes a first wick 11 formed of copper fibers 11*a*, and a second wick formed of carbon fibers 12*a*. The first wick 11 is sintered to be fixed to an inner face 21*a* of a flat wall 21 while holding the second wick 12 therein.

4 Claims, 8 Drawing Sheets

HEAT PIPE

The present invention claims the benefit of Japanese Patent Application No. 2014-145301 filed on Jul. 15, 2014 with the Japanese Patent Office, the disclosure of which is incorporated herein by reference in its entirety.

BACKGROUND

Field of the Invention

The present invention relates to an art of a heat pipe having a wick structure.

Discussion of the Related Art

Heat pipes have been widely used as a heat transport device. The conventional heat pipe comprises a tubular sealed container and working fluid encapsulated therein, and brought into contact to a heat generating member. The working fluid is vaporized by a heat of the heat generating element transmitted to one end of the heat pipe and aspirated to the other end side due to difference in pressure inside and outside.

The end portion of the heat pipe thus brought into contact to the heat generating element serves as an evaporating portion where evaporation of the working fluid takes place, and the other end portion is brought into contact to a radiation member to serve as a condensing portion where condensation of the working fluid takes place as a result of transmitting heat to the radiation member. The working fluid condensed at the condensing portion is returned to the evaporating portion by a capillary pumping of a wick structure arranged in the heat pipe.

The container of the heat pipe may be altered arbitrarily according to a configuration of a cooling object. For example, if the cooling object is a small electronic device, the container of the heat pipe may be flattened to be fitted into the device.

JP-A-2013-002641 describes a flat heat pipe having a wick structure. According to the teachings of JP-A-2013-002641, a bundle of thin metal fibers is used as the wick.

However, the wick structure taught by JP-A-2013-002641 occupies an inner space of the container serving as a vapor passage. In the flat heat pipe of JP-A-2013-002641, the inner space of the container is rather narrow and hence divided into two spaces by the wick formed throughout between upper and lower inner faces. In the heat pipe of this kind, the vapor is not allowed to flow through the vapor passages in sufficient amount.

Nonetheless, if number of fibers forming the wick is reduced to expand the vapor passage in the heat pipe taught by JP-A-2013-002641, the capillary pumping of the wick may be weakened and hence the working fluid cannot be returned sufficiently to the evaporating portion.

In addition, it is difficult to arrange a wick structure having a complicated structure in the thin flat sealed container and there is a need for simplifying manufacturing of the heat pipes.

SUMMARY OF THE INVENTION

The present invention has been conceived noting the foregoing technical problems, and it is therefore an object of the present invention is to provide a flat heat pipe having enhanced heat transport capacity that can be manufactured easily.

The heat pipe according to the present invention is comprised of: a sealed container flattened to have a pair of flat walls and sealed at both longitudinal ends; a working fluid encapsulated in the container; a wick structure that pulls the working fluid by a capillary pumping; an evaporating portion that is situated on one of the longitudinal end of the container at which evaporation of the working fluid takes place; and a condensing portion that is situated on the other longitudinal end of the container at which condensation of the working fluid takes place. The wick structure includes a first wick formed of a plurality of copper fibers extending from the condensing portion to the evaporating portion, and a second wick formed of a plurality of carbon fibers. The second wick is heaped on an inner face of one of the flat walls of the container, and the first wick is fixed to the inner surface of said one of the flat walls of the container while covering the heap of the second wick.

Specifically, the second wick may be formed from the condensing portion to the evaporating portion.

Alternatively, the second wick may be formed only in the evaporating portion.

A diameter of each carbon fiber is smaller than that of each copper fiber.

A melting point of copper is lower than that of carbon. According to the present invention, the second wick made of carbon fibers are neither bonded to one another nor fixed to the inner face of the container at the sintering temperature of the first wick formed of the copper fibers, but it can be held by the sintered first wick on the inner face of the container. In addition, heat conductivity of carbon is higher than that of copper. According to the present invention, therefore, thermal resistance of the heat pipe can be reduced by thus forming the second wick made of carbon fibers so that heat transport capacity of the heat pipe can be enhanced. Further, the heat pipe thus having two kinds of wicks can be manufactured easily without applying binder agent or the like to the carbon wick.

BRIEF DESCRIPTION OF THE DRAWINGS

Features, aspects, and advantages of exemplary embodiments of the present invention will become better understood with reference to the following description and accompanying drawings, which should not limit the invention in any way.

DETAILED DESCRIPTION OF THE PREFERRED EMBODIMENT(S)

Hereinafter, preferred examples of the heat pipe according to the present invention will be explained in more detail with reference to the accompanying drawings.

Figure 1:
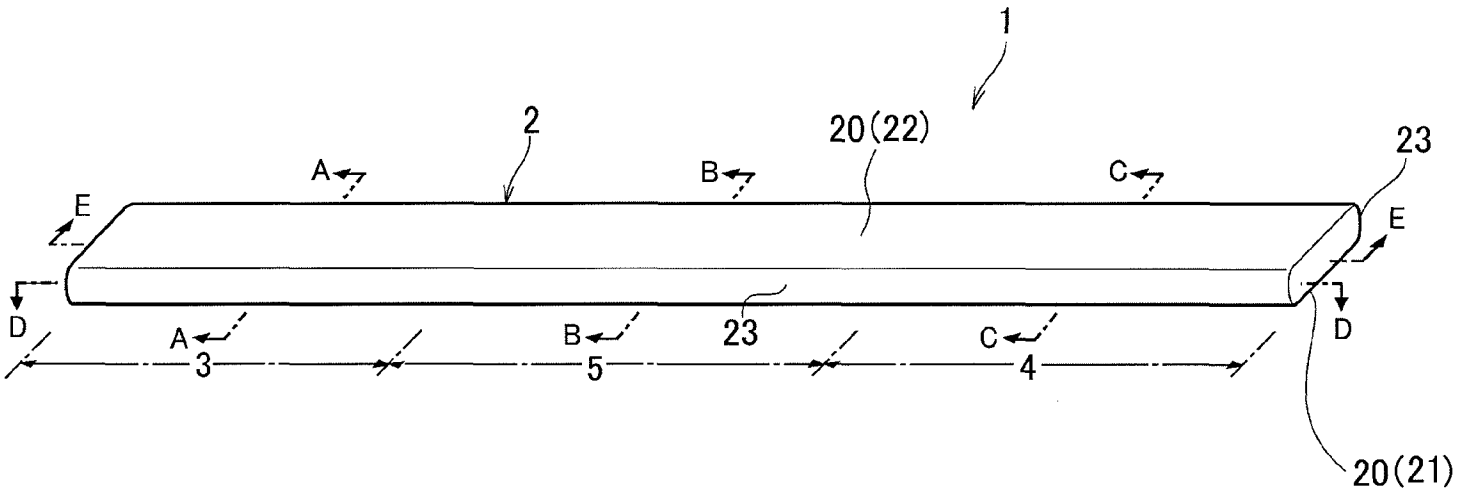
FIG. 1 is a perspective view showing a preferred example of the heat pipe.

Referring now to FIG. 1, there is shown a heat pipe 1 according to the first example. The heat pipe 1 shown therein is a heat transport device adapted to transport heat in the form of latent heat of working fluid encapsulated in a sealed container 2. The container 2 is a hollow container made of metal plate having a constant thickness and high heat conductivity such as a copper plate, a steel plate, an aluminum plate and so on, and flattened to have wider width and sealed at both longitudinal ends.

The container 2 is comprised of a flat wall 20 having a predetermined width and a curved side wall 23. The flat wall includes a lower flat wall 21 and an upper flat wall 22.

For example, a known phase changeable liquid such as water, alcohol, ammonia etc. may be used as a working fluid (not shown) for transporting heat.

One of end portions of the heat pipe 1 is brought into contact to the heat generating element such as a CPU of an electronic device to serve as an evaporating portion 3 at which evaporation of the working fluid takes place, and the other end portion is brought into contact to a radiation member such as a metal fin array and a heat sink to serve as condensing portion 4 at which the working fluid is condensed into a liquid phase. An intermediate portion of the heat pipe 1 may be covered by a not shown heat insulating material to serve as an insulating portion 5, and the evaporated working fluid flows therethrough without changing a phase.

Thus, in the heat pipe 1, the evaporating portion 3 is heated by the heat generating element, and the heat of the heat generating element is transported to the radiating portion 4 in the form of latent heat of the working fluid.

Figure 2A:
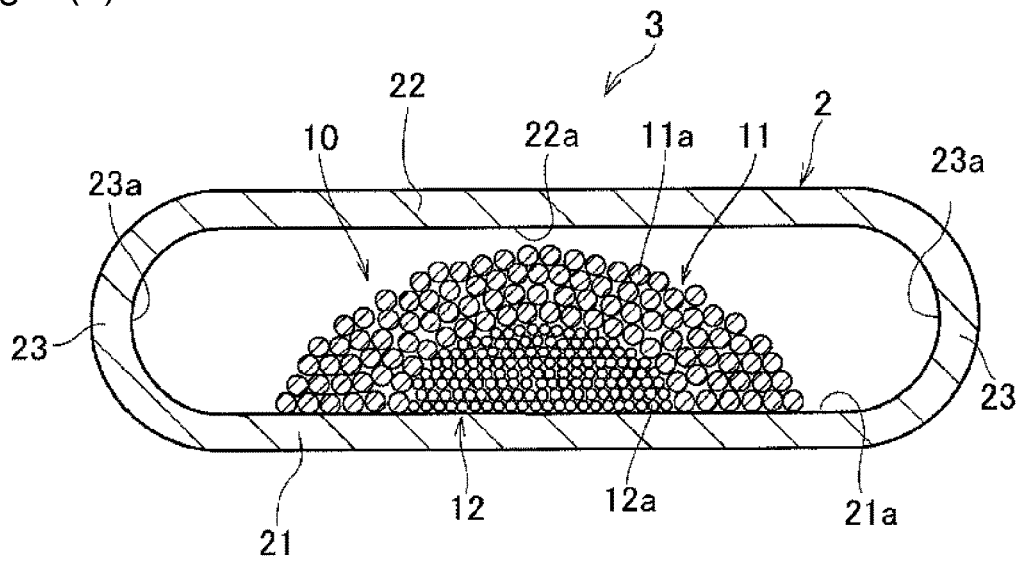
FIG. 2 (*a*) is a cross-sectional view of the heat pipe according to the first example showing a cross-section along the line A-A in FIG. 1, and FIG. 2 (*b*) is a cross-sectional view showing a cross-section along the line B-B or the line C-C in FIG. 1.
Figure 2B:
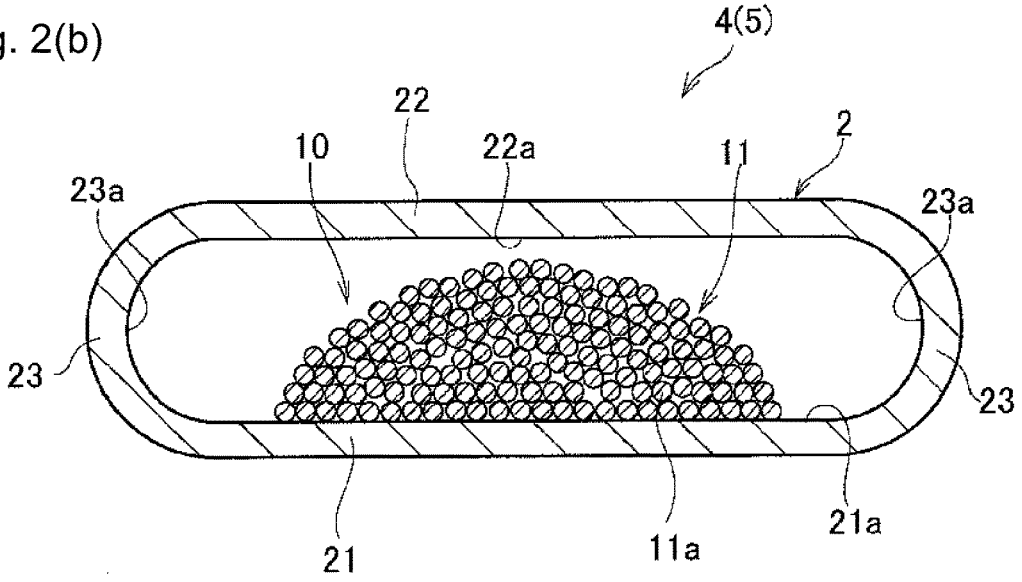

An internal structure of the heat pipe 1 will now be explained with reference to FIGS. 2 and 3. As illustrated in FIGS. 2 (*a*) and 2 (*b*), an inner face of the container 2 is entirely smooth and curved at each side wall 23. A wick structure 10 is formed on an inner face 21*a* of the lower flat wall 21 in a manner not to contact an inner face 22*a* of the upper flat wall 22.

The wick structure 10 is a bundle of metal fibers comprising a first wick 11 and a second wick 12. Specifically, the first wick 11 is a bundle of sintered copper fibers 11*a* adapted to return the working fluid condensed at the condensing portion 4 to the evaporating portion 3, and the second wick 12 is formed of carbon fibers 12*a* but it is not sintered.

Diameters of the copper fiber 11*a* and the carbon fiber 12*a* respectively fall within a range from several micrometers to several tens of micrometers. However, diameter of each copper fiber 11*a* is five to ten times larger than that of each carbon fiber 12*a*.

As shown in FIG. 2 (*a*), in the evaporating portion 3, the carbon fiber 12*a* is heaped on a width center of the inner face 21*a* of the lower flat wall 21 to form the second wick 12, and covered by the first wick 11 made of the copper fiber 11*a*. That is, the first wick 11 as an outer layer of the wick structure 10 is also formed on the inner face 21*a* of the lower flat wall 21 in a manner to entirely cover the heap of the second wick 12, and sintered to be fixed to the inner face 21*a* while keeping the second wick 12 in a bundle.

As described, the second wick 12 is not sintered and hence it is not fixed to the inner face 21*a* of the lower flat wall 21. In addition, each carbon fiber 12*a* is not coated with resin adhesive agent or the like and hence the second wick 12 is not bonded to the inner face 21*a* of the lower flat wall 21.

According to the first example, the second wick 12 is arranged only in the evaporating portion 3 and it is not arranged in the condensing portion 4 and the insulating portion 5. As shown in FIG. 2 (*b*), in the condensing portion 4 or the insulating portion 5, only the first wick 11 is formed on the inner face 21*a* of the lower flat wall 21.

Figure 3A:
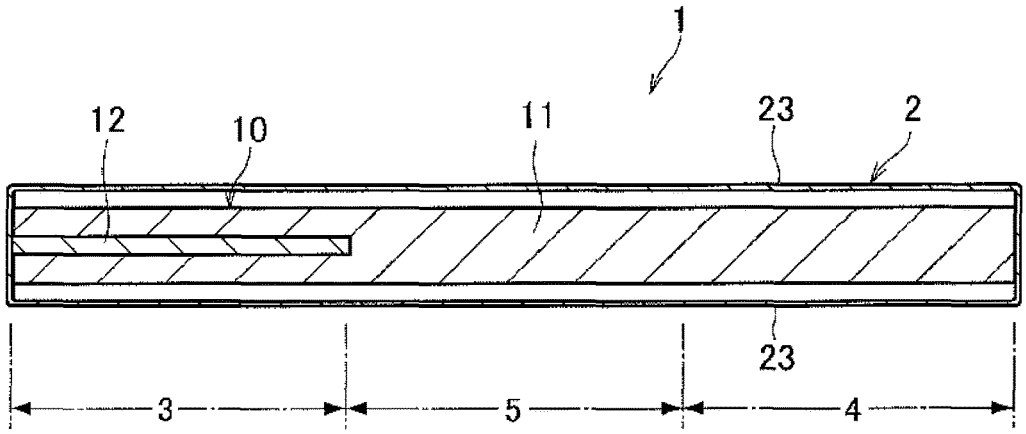
FIG. 3 (*a*) is a cross-sectional view of the heat pipe according to the first example showing a cross-section along the line D-D in FIG. 1, and FIG. 3 (*b*) is a cross-sectional view showing a cross-section along the line E-E in FIG. 1.
Figure 3B:
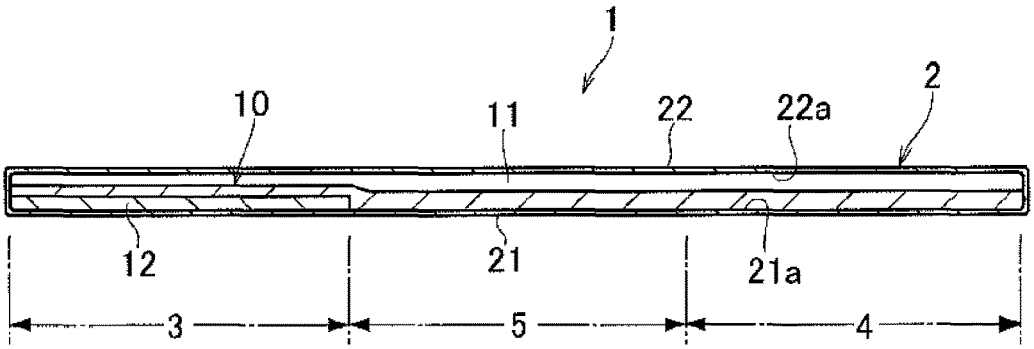

FIG. 3 (*a*) is a cross-sectional view showing a cross-section of the heat pipe 1 along the line D-D in FIG. 1, and FIG. 3 (*b*) is a cross-sectional view showing a cross-section of the heat pipe 1 along the line E-E in FIG. 1. As can be seen from FIGS. 3 (*a*) and 3 (*b*), the wick structure 10 is arranged throughout the entire length of the container 2. Specifically, the first wick 11 formed of the copper fibers 11*a* extends on the width center of inner face 21*a* of the lower flat wall 21 from the condensing portion 4 to the evaporating portion 3 via the insulating portion 5, but the second wick 12 formed of the carbon fibers 12*a* extends inside of the first wick 11 only in the evaporating portion 3. That is, the condensing portion 4 is connected to the evaporating portion 3 through same number of the copper fiber 11*a*.

As described, the first wick is sintered to fix the copper fibers 11*a*. Each clearance among the copper fibers 11*a* serves respectively as a flow passage (to be called the "first passage" hereinafter) for returning the working fluid in the liquid phase from the condensing portion 4 to the evaporating portion 3 by a capillary pumping of the wick structure 10.

In the second wick 12, each clearance among carbon fibers 12*a* also serves as a flow passage (to be called the "second passage" hereinafter) respectively. As described, a diameter of each carbon fiber 12*a* forming the second wick 12 is respectively smaller than that of each copper fiber 11*a* forming the first wick 11 and hence each second passage in the second wick 12 is respectively narrower than the first passage in the first wick 11. That is, the capillary pumping of the second wick 12 is stronger than that of the first wick 11 so that the working fluid flowing through the first passage in the first wick 11 is pulled into the second passage in the second wick 12 to be returned efficiently to the evaporating portion 3.

Thus, the second wick 12 made of the carbon fibers 12*a* is arranged only in the evaporating portion 3, and hence a thickness of the wick structure 10 in the evaporating portion 3 is thicker than those of the insulating portion 5 and the condensing portion 4 which are substantially constant as illustrated in FIG. 3 (*b*). Optionally, the wick structure 10 may be flattened according to need by widening a width thereof in the evaporating portion 3.

Here will be explained a heat transport cycle in the heat pipe 1. In the heat pipe 1, the working fluid penetrating into the first wick 11 and the second wick 12 is evaporated at the evaporating portion 3 by the heat of the not shown heat generating element.

Heat conductivity of the second wick 12 formed of the carbon fibers 12*a* is higher than that of the first wick 11 formed of the copper fiber 11*a*. In addition, the carbon fibers 12*a* are directly brought into contact to the inner face 21*a* of the lower flat wall 21 so that the heat of the lower flat wall 21 can be transferred efficiently to the second wick 12. That is, thermal resistance of the heat pipe 1 during evaporation of the working fluid at the evaporating portion 3 can be reduced thereby enhancing heat transport capacity of the heat pipe 1.

The working fluid vaporized at the evaporating portion 3 flows toward the condensing portion 4 where an internal pressure and a temperature are lower than those in the evaporating portion 3 through an internal space of the container 2. According to the first example, the wick structure is formed only on the lower flat wall 21 so that the vapor of the working fluid is allowed to flow smoothly to the condensing portion 4 without a hindrance.

The vapor of the working fluid is cooled to be liquefied at the condensing portion 4 and penetrates into the first wick 11. Then, the working fluid in the liquid phase returns to the evaporating portion 3 through the first passages of the first wick 11.

As described, a diameter of each copper fiber 11*a* forming the first wick 11 is respectively larger than that of each carbon fiber 12*a* forming the second wick 12*a* and hence a cross-sectional area of each first passage in the first wick 11 is respectively larger than that of each second passage in the second wick 12. That is, a pressure loss in the first passage is less than that in the second passage. In addition, the capillary pressure of the second wick is stronger than that of the first wick to pull the working fluid. For these reasons, the working fluid can be returned efficiently to the evaporating portion 3.

The working fluid reaches the evaporating portion 3 through the first passages of the first wick 11 flows into the second passages in the second wick 12, and evaporated again by the heat of the heat generating element applied to the evaporating portion 3. Such phase change and migration of the working fluid takes place repeatedly in the heat pipe 1.

Next, the manufacturing method of the heat pipe 1 will be explained with reference to FIG. 4. According to the preferred example of the manufacturing method, the copper fibers 11*a* of the first wick 11 is sintered first, and then the container 2 is pressed into the flat shape.

Figure 4A:
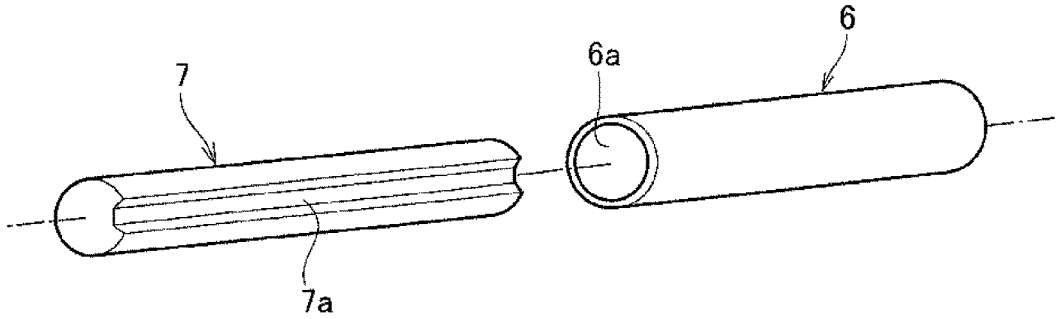
FIG. 4 (*a*) is a perspective view showing one example of a jig and a cylindrical material, FIG. 4 (*b*) is a cross-sectional view showing a cross-section of metal fibers bundled by the jig in the cylindrical material, and FIG. 4 (*c*) is a cross-sectional view showing a cross-section of the metal fibers sintered in the cylindrical material.
Figure 4B:
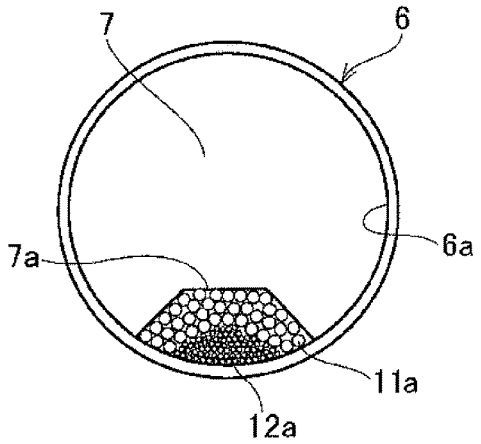
Figure 4C:
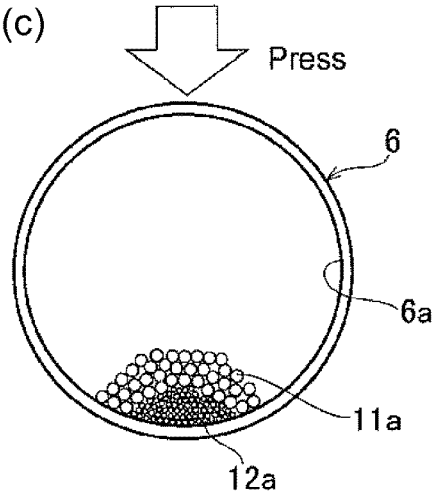

As shown in FIG. 4 (*a*), a material 6 of the container 2 made of copper still remains in the cylindrical shape before sintering the wick structure 10. First of all, the fibers 11*a* and 12*a* are set in a groove 7*a* of a jig 7, and the jig 7 is inserted into the material 6 that still remains in a cylindrical shape together with the fibers 11*a* and 12*a*.

Specifically, the jig 7 is a column member having the longitudinal groove 7*a* on its circumferential face, and a depth and a width of the groove 7*a* are entirely constant. An outer diameter of the jig 7 is slightly smaller than an inner diameter of the material 6 so that the jig 7 can be inserted into the material 6. Then, the material 6 is sintered together with the jig 7 holding the fibers 11*a* and 12*a* in the groove 7*a*.

As shown in FIG. 4 (*b*), the copper fibers 11*a* and the carbon fibers 12*a* are placed on an inner face 6*a* of the material 6 by the groove 7*a* of the jig 7 while being bundled in such a manner that the carbon fibers 12*a* are covered entirely by an outer layer of the copper fibers 11*a*.

Specifically, the copper fibers 11*a* are set in the groove 7*a* of the jig 7 first of all, and then the carbon fibers 12*a* are set on the copper fibers 11*a*. Then, the jig 7 holding the fibers 11*a* and 12*a* in the groove 7*a* is inserted into the material 6. Alternatively, it is also possible to insert the copper fibers 11*a* and the carbon fibers 12*a* into the groove 7*a* after inserting the jig 7 into the material 6.

Then, as shown in FIG. 4 (*b*), the copper fibers 11*a* and the carbon fibers 12*a* held in the groove 7*a* of the jig 7 are sintered in the material 6. Consequently, the copper fibers 11*a* are bonded to one another and also fixed to the inner face 6*a* of the material 6 while holding the carbon fibers 12*a*. However, the melting point of carbon is higher than that of copper and hence the carbon fibers 12*a* are neither bonded to one another nor fixed to the inner face 6*a* of the material 6 at the sintering temperature of the carbon fibers 11*a*. Thereafter, the jig 7 is withdrawn from the material 6.

Consequently, as shown in FIG. 4 (*c*), the carbon fibers 12*a* are fixed onto the inner face 6*a* of the material 6 by the sintered outer layer of the copper fibers 11*a* being fixed onto the inner face 6*a*, without applying resin adhesive agent or the like thereto. Then, the material 6 is pressed to be flattened in such a manner that the portion of the material 6 on which the fibers 11*a* and 12*a* are attached is formed into the lower flat wall 21. Since the carbon fibers 12*a* are held in the copper fibers 11*a* only in the evaporating portion 3, density of the fibers in the insulating portion 5 and the condensing portion 4 is lower than that in the evaporating portion 3 provided that the depth of the groove 7*a* of the jig 7 is entirely constant. In this case, the copper fibers 11*a* may not be fixed tightly to the inner face 6*a* of the material 6. In order to fix the copper fibers 11*a* tightly to the inner face 6*a* of the material 6, the jig 7 may be formed in such a manner that the depth of the groove 7 is shallower in the insulating portion 5 and the condensing portion 4 than that in the evaporating portion 3.

Thus, in the heat pipe according to the preferred example, the second wick 12 is not sintered at the sintering temperature of the first wick 11, but the second wick 12 can be fixed to the inner face 6*a* of the material 6 by sintering the first wick 11.

As described, heat conductivity of the second wick 12 formed of the carbon fibers 12*a* is higher than that of the first wick 11 formed of the copper fiber 11*a*. In addition, the carbon fibers 12*a* are directly brought into contact to the inner face 21*a* of the lower flat wall 21 so that the heat of the lower flat wall 21 can be transferred efficiently to the second wick 12. That is, thermal resistance of the heat pipe 1 during evaporation of the working fluid at the evaporating portion 3 can be reduced thereby enhancing heat transport capacity of the heat pipe 1.

As also described, a diameter of each copper fiber 11*a* forming the first wick 11 is respectively larger than that of each carbon fiber 12*a* forming the second wick 12*a* and hence a cross-sectional area of each first passage in the first wick 11 is respectively larger than that of each second passage in the second wick 12. That is, a pressure loss in the first passage is less than that in the second passage. In addition, the capillary pressure of the second wick is stronger than that of the first wick to pull the working fluid. For these reasons, the working fluid can be returned efficiently to the evaporating portion 3.

Figure 5A:
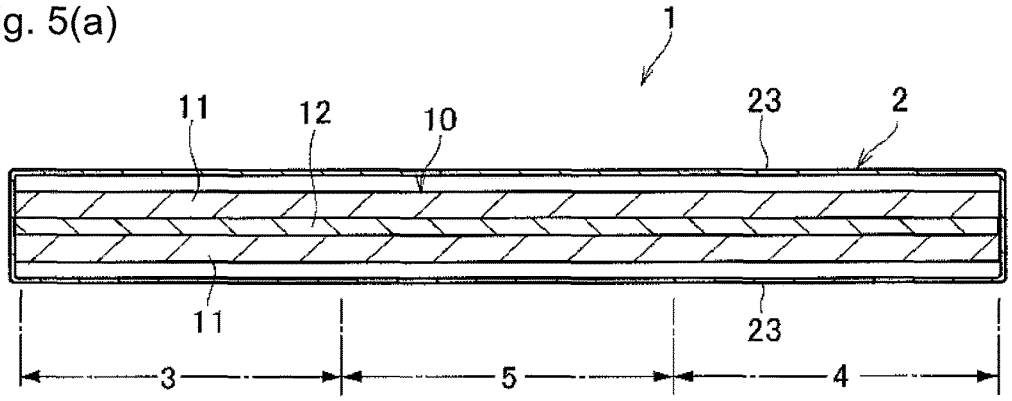
FIG. 5 (*a*) is a cross-sectional view of the heat pipe according to the second example showing a cross-section along the line D-D in FIG. 1, FIG. 5 (*b*) is a cross-sectional view showing a cross-section along the line E-E in FIG. 1, and FIG. 5 (*c*) is a cross-sectional view showing a cross-section along the line A-A, B-B or C-C in FIG. 1.
Figure 5B:
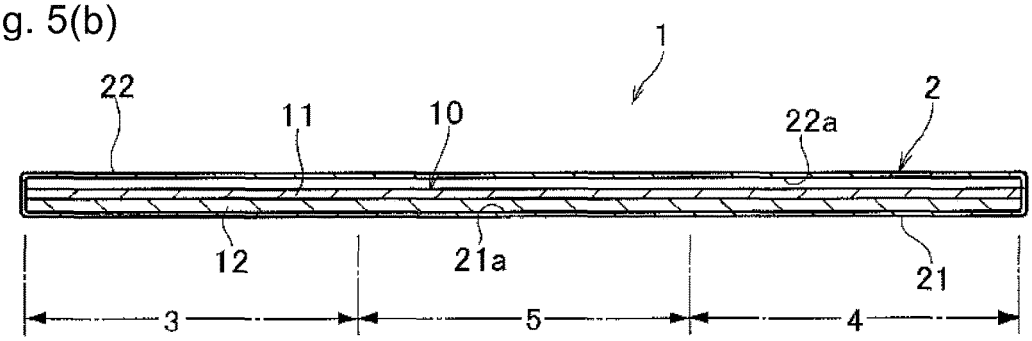
Figure 5C:
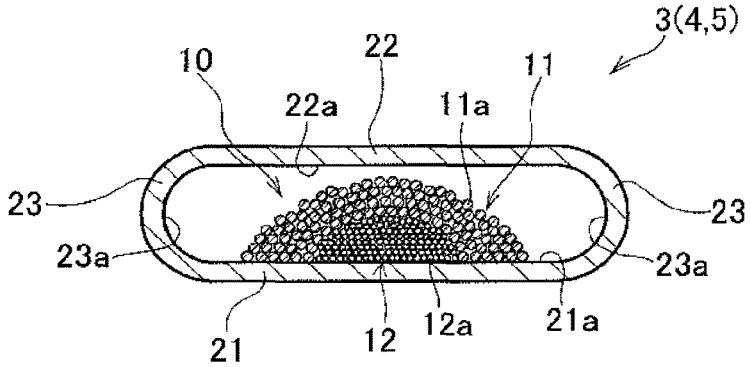

Turning now to FIG. 5, there is shown the second example of the heat pipe 1. According to second example of the present invention, the second wick 12 of the carbon fibers

12*a* are formed throughout in the heat pipe 1 from the evaporating portion 3 to the condensing portion 4. Here, in the following explanation of the second example, common reference numerals are allotted to the elements identical to those in the first example, and detailed explanation for those elements will be omitted.

As shown in FIGS. 5 (*a*) and 5 (*b*), the second wick 12 is formed throughout in the container 2 from the evaporating portion 3 to the condensing portion 4. In this case, lengths of the carbon fibers 12*a* forming the second wick 12 are similar to those of the copper fibers 11*a* forming the first wick 11.

As shown in FIG. 5 (*c*), according to the second example, the carbon fiber 12*a* is heaped on a width center of the inner face 21*a* of the lower flat wall 21 throughout from the evaporating portion 3 to the condensing portion 4 to form the second wick 12. The first wick 11 as the outer layer of the wick structure 10 is also formed on the inner face 21*a* of the lower flat wall 21 in a manner to entirely cover the heap of the second wick 12, and sintered to be fixed to the inner face 21*a* while keeping the second wick 12 in a bundle by the foregoing procedures.

According to the second example, the thermal resistance in the heat pipe 1 can be reduced by thus arranging the second wick 12 made of the carbon fibers 12 (*a*) entirely in the container 2. In addition, the copper fibers 11 (*a*) and the carbon fibers 12 (*a*) can be positioned easily.

Next, here will be explained test result of heat transport capacities of the heat pipes according to the first example, the second example, and the comparison example.

Figure 6A:
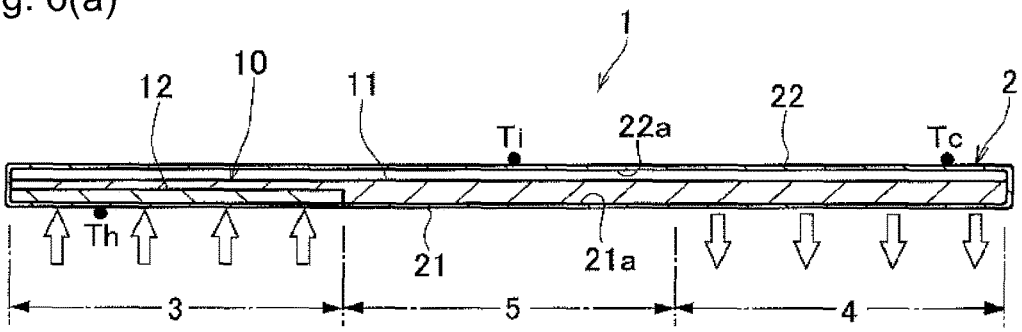
FIG. 6 (*a*) is a cross-sectional view showing an internal structure of the of the heat pipe according to the first example, FIG. 6 (*b*) is a cross-sectional view showing an internal structure of the of the heat pipe according to the second example, and FIG. 6 (*c*) is a cross-sectional view showing an internal structure of the of the heat pipe according to the comparison example.
Figure 6B:
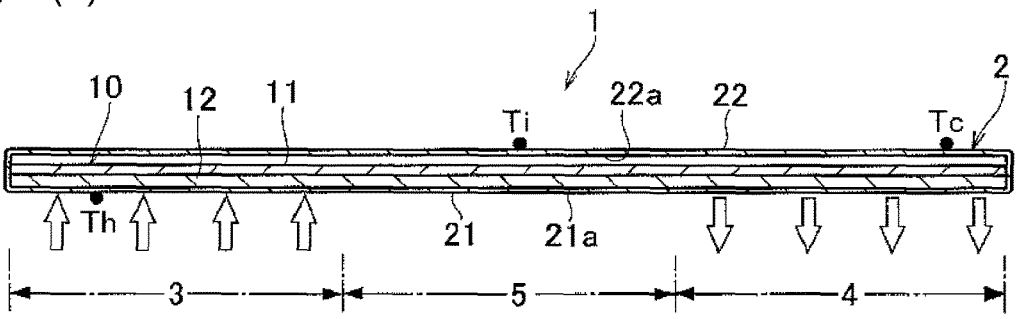
Figure 6C:
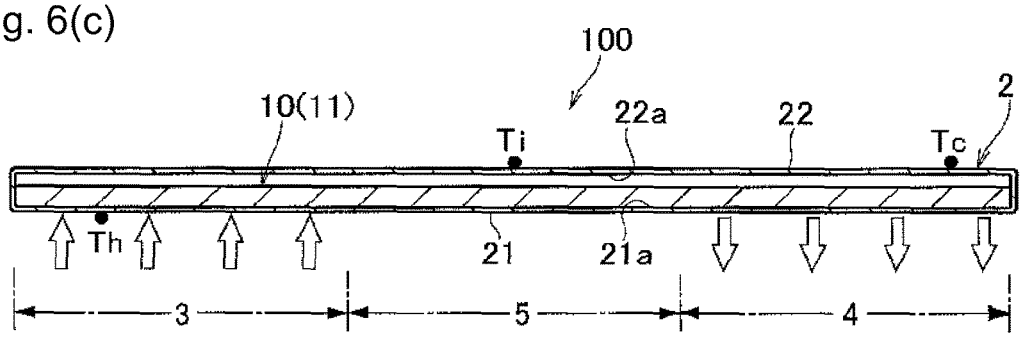

Turning now to FIG. 6, FIG. 6 (*a*) shows the heat pipe 1 according to the first example in which the second wick 12 is arranged only in the evaporating portion 3, FIG. 6 (*b*) shows the heat pipe 1 according to the second example in which the second wick 12 is arranged throughout in the container 2, and FIG. 6 (*c*) shows a heat pipe 100 according to the comparison example in which only the first wick 11 made of the copper fibers 11 (*a*) is arranged in the container 2. In FIG. 6, upward arrows indicate heat input to the heat pipe, and downward arrows indicate heat radiation from the heat pipe.

In the test, each first wick 11 of the heat pipes 1 of the first and the second examples was individually formed of 300 copper fibers 11*a* the diameters thereof were 0.05 mm respectively, and each second wick 12 of the heat pipes 1 of the first and the second examples was formed of 1000 carbon fibers 12*a* the diameters thereof were 0.005 mm respectively. By contrast, only the first wick 11 formed of 300 copper fibers 11*a* the diameters thereof were 0.05 mm respectively was arranged in the heat pipes 1 of the comparison example.

A tubular material 6 whose external diameter was 6.0 mm and whose length was 150 mm was individually used to prepare the containers 2 of the first example, the second example and the comparison example, and each material 6 was individually pressed to be shaped into a flat face having a thickness of 1.0 mm and a width of 9.1 mm.

Figure 7A:
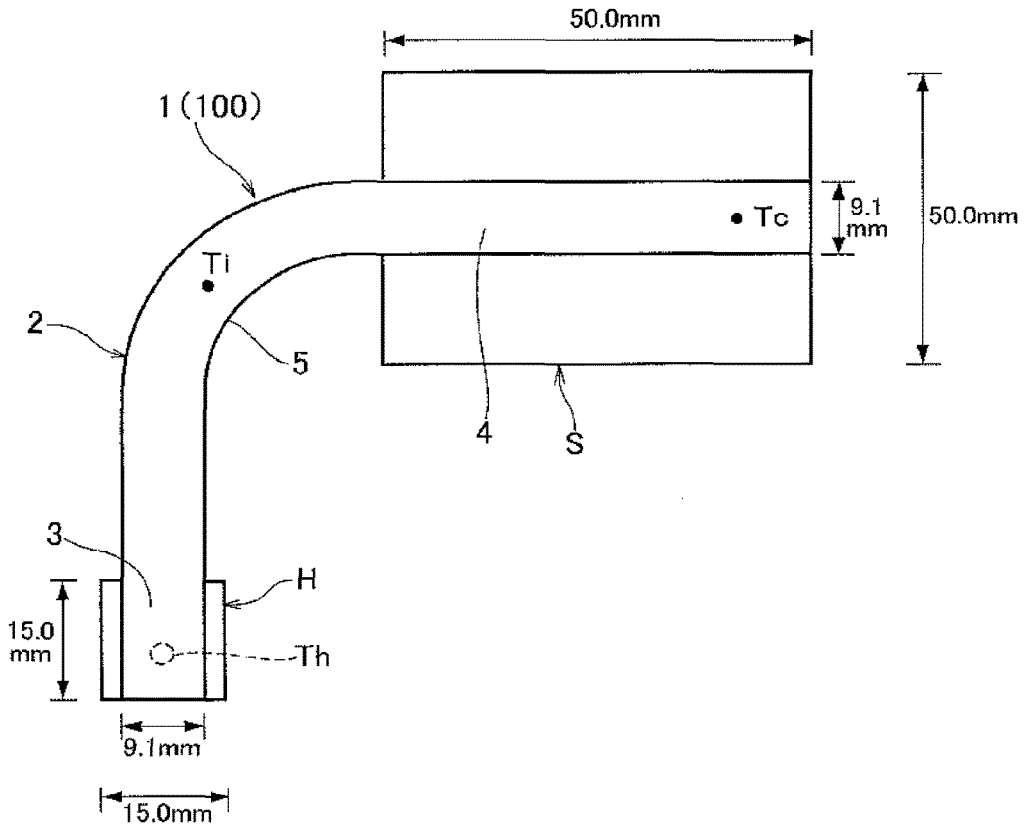
FIG. 7 (*a*) is a top view of a testing device, and FIG. 7 (*b*) is a front view of a testing device.
Figure 7B:
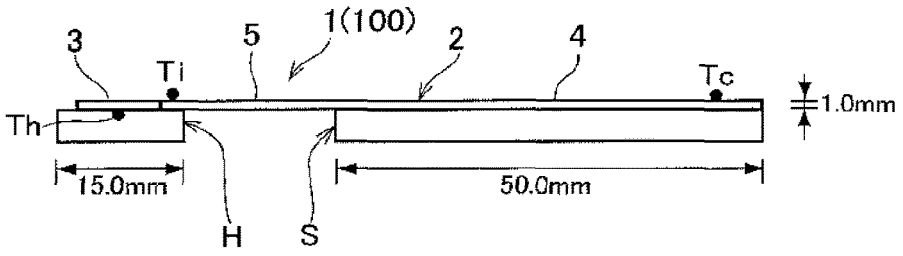

As shown in FIG. 7 (*a*), an electric heater H whose length and width were respectively 15 mm was attached to one end of the heat pipe to serve as the heat generating element, and a radiating device S whose length and width were respectively 50 mm is attached to the other end of the heat pipe. In addition, each heat pipe 1 and 100 is individually flexed to a substantially right angle at its intermediate portion.

As shown in FIG. 7 (*b*), an outer face of the lower flat wall 21 of the evaporating portion 3 is brought into contact the heater H, and an outer face of the lower flat wall 21 of the condensing portion 4 is brought into contact the radiating device S. In the test, each heat pipe of the first example, the second example and the comparison example was individually attached horizontally to a test equipment.

Temperatures of each heat pipe and the heater H was measured by a conventional thermocouple sensor. Specifically, as shown in FIGS. 6 (*a*), 6 (*b*) and 6 (*c*), a surface temperature Th of the heater H contacted to the lower flat wall 21 of the evaporating portion 3, a surface temperature Ti of the upper flat wall 22 of the insulating portion 5, and a surface temperature Tc of the upper flat wall 22 of the condensing portion 4 were measured.

The evaporating portion 3 of each heat pipe was heated by energizing the heater H under room temperature, and the surface temperatures Th, Tc, and Ti were measured respectively while changing a heat input Q to the evaporating portion 3. Then, a thermal resistance R of each heat pipe was calculated under the condition that a temperature Ti at the insulating portion became 60 degrees C. as expressed by the following expression:

$$R=(Th-Tc)/Q.$$

Figure 8:
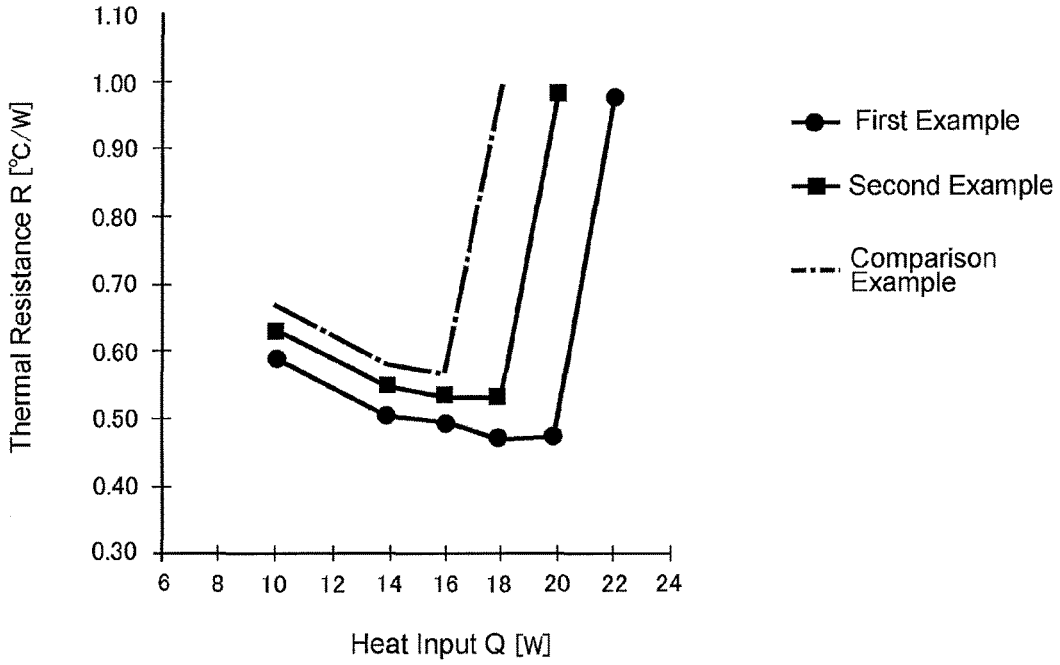
FIG. 8 is a graph indicating testing result of the heat pipes according to the first example, the second examples, and the comparison examples.

The calculation results of the thermal resistance R of the heat pipes of the first example, the second example and the comparison example are plotted in FIG. 8.

In FIG. 8, a line penetrating through round dots represents the thermal resistance R of the heat pipe according to the first example, a line penetrating through square dots represents the thermal resistance R of the heat pipe according to the second example, and a dot-and-dash line represents the thermal resistance R of the heat pipe according to the comparison example.

As can be seen from FIG. 8, the smallest thermal resistance R of the heat pipe according to the first example was 0.48 when the heat input Q to the evaporating portion 3 was 20 W. That is, a maximum heat transporting quantity QMAX of the heat pipe according to the first example was achieved by 20 W of the heat input that was the largest heat input in the tested heat pipes. In turn, the smallest thermal resistance R of the heat pipe according to the second example was 0.53 when the heat input Q to the evaporating portion 3 was 18 W. Thus, a maximum heat transporting quantity QMAX of the heat pipe according to the second example was achieved by 18 W of the heat input that was the second largest heat input in the tested heat pipes. However, the smallest thermal resistance R of the heat pipe according to the comparison example was 0.58 when the heat input Q to the evaporating portion 3 was 16 W. That is, a maximum heat transporting quantity QMAX of the heat pipe according to the comparison example was achieved by 16 W of the heat input that was the smallest heat input in the tested heat pipes.

If the heat input Q to the evaporating portion 3 exceeds the limitation value, the working fluid in the evaporating portion 3 would dry out and the thermal resistance R of the heat pipe would be increased significantly. That is, the maximum heat transporting quantity QMAX of the heat pipe is increased with an increment of the limitation value of the heat input to the evaporating portion 3.

In conclusion, the maximum heat transporting quantity QMAX of the heat pipe according to the first example was largest in the tested heat pipes, the maximum heat transporting quantity QMAX of the heat pipe according to the second example was second largest in the tested heat pipes, and the maximum heat transporting quantity QMAX of the heat pipe according to the comparison example was smallest in the tested heat pipes.

The structure of the heat pipe 1 according to the preferred examples may be modified according to need within the spirit of the present invention. For example, the wick structure 10 may also be bundled by a string or by twisting the fibers.

In addition, the copper fibers 11*a* may be mixed with the carbon fibers 12*a* at the boundary therebetween unless at least the carbon fibers 12*a* are fixed onto the lower flat wall 21 of the container 2 by the copper fibers 11*a* being fixed thereto.

Further, the wick structure 10 may also be formed on the inner face 22*a* of the upper flat wall 22 instead of the inner face 21*a* of the lower flat wall 21.

What is claimed is:

1. A heat pipe, comprising:

a sealed container flattened to have a pair of flat walls and sealed at both longitudinal ends;

a working fluid encapsulated in the container;

a wick structure that pulls the working fluid by a capillary pumping;

an evaporating portion that is situated on one of the longitudinal ends of the container at which evaporation of the working fluid takes place; and a condensing portion that is situated on the other longitudinal end of the container at which condensation of the working fluid takes place;

wherein the wick structure is arranged on a center portion in a width direction of an inner face of a single wall of the pair of flat walls;

wherein the wick structure is not situated on distal ends in the width direction of the single wall of the pair of flat walls wherein the wick structure includes a first wick formed of a plurality of copper fibers extending from the condensing portion to the evaporating portion, and a second wick formed of a plurality of carbon fibers;

wherein the second wick is heaped on the inner face of the single wall of the pair of flat walls;

wherein the first wick is sintered so as to bond together the plurality of copper fibers and is fixed to the inner face of the single wall of the pair of flat walls while covering the heap of the second wick;

wherein a gap is formed between an inner face of the other one of the pair of flat walls and the wick structure, the gap extending across the entire width of the wick structure; and wherein the diameter of each one of the plurality of copper fibers is 5 to 10 times larger than the diameter of each one of the plurality of carbon fibers.

2. The heat pipe as claimed in claim 1, wherein the second wick is formed from the condensing portion to the evaporating portion.

3. The heat pipe as claimed in claim 1, wherein the second wick is formed only in the evaporating portion.

4. The heat pipe as claimed in claim 1, wherein the second wick is not sintered to the inner face of the single wall of the pair of flat walls on which the second wick is heaped.

* * * * *